US006896343B1

(12) United States Patent
Jaeger

(10) Patent No.: US 6,896,343 B1
(45) Date of Patent: May 24, 2005

(54) STUD-SUPPORTED STORAGE ASSEMBLY

(76) Inventor: Linda Jaeger, 1623 N. Cora St., Crest Hill, IL (US) 60435

( * ) Notice: Subject to any disclaimer, the term of this patent is extended or adjusted under 35 U.S.C. 154(b) by 0 days.

(21) Appl. No.: 10/621,723

(22) Filed: Jul. 18, 2003

(51) Int. Cl.[7] ..... A47F 5/08
(52) U.S. Cl. ..... 312/242; 312/248
(58) Field of Search ..... 312/242, 245, 312/246, 248, 204; 52/29, 32; 248/239, 240

(56) References Cited

U.S. PATENT DOCUMENTS 1,901,384 A * 3/1933 Wagenhorst ..... 362/128
3,069,215 A * 12/1962 Dodge ..... 312/117
3,172,632 A * 3/1965 Borg ..... 248/201
3,207,566 A * 9/1965 Grieco et al. ..... 312/209
3,333,912 A * 8/1967 Kunz et al. ..... 312/231
3,802,102 A * 4/1974 Licciardi ..... 40/564
3,834,782 A * 9/1974 Pampinella ..... 312/248
4,064,992 A * 12/1977 Ralston et al. ..... 211/75
4,681,380 A * 7/1987 Carlin ..... 312/242
5,772,295 A * 6/1998 Sundmark ..... 312/246
6,755,493 B1 * 6/2004 Krietzman et al. ..... 312/248

FOREIGN PATENT DOCUMENTS

JP 09246736 * 9/1997

* cited by examiner

*Primary Examiner*—Janet M. Wilkens

(57) ABSTRACT

A stud-supported storage assembly for providing addition storage space upon a wall member. The stud-supported storage assembly includes a support assembly including elongate stud members being spaced apart, and also including a wall member being attached to the elongate stud members; and also includes a shelf assembly including a shelf member being hingedly attached to the support assembly and having bottom, side, and end walls and an open top; and further includes a shelf mounting assembly for hingedly mounting the shelf member to the support assembly.

5 Claims, 4 Drawing Sheets

STUD-SUPPORTED STORAGE ASSEMBLY

BACKGROUND OF THE INVENTION

1. Field of the Invention

The present invention relates to pivotal shelves and more particularly pertains to a new stud-supported storage assembly for providing addition storage space upon a wall member.

2. Description of the Prior Art

The use of pivotal shelves is known in the prior art. More specifically, pivotal shelves heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 2,166,430; U.S. Pat. No. 1,707,013; U.S. Pat. No. 5,368,378; U.S. Pat. No. 5,882,094; U.S. Pat. No. 5,819,958; U.S. Pat. No. 5,577,819; and U.S. Pat. No. Des. 333,238.

While these devices fulfill their respective, particular objectives and requirements, the aforementioned patents do not disclose a new stud-supported storage assembly. The prior art includes cabinets having doors and which are mounted directly to the wall structures.

SUMMARY OF THE INVENTION

The general purpose of the present invention, which will be described subsequently in greater detail, is to provide a new stud-supported storage assembly which has many of the advantages of the pivotal shelves mentioned heretofore and many novel features that result in a new stud-supported storage assembly which is not anticipated, rendered obvious, suggested, or even implied by any of the prior art pivotal shelves, either alone or in any combination thereof. The present invention includes a support assembly including elongate stud members being spaced apart, and also including a wall member being attached to the elongate stud members; and also includes a shelf assembly including a shelf member being hingedly attached to the support assembly and having bottom, side, and end walls and an open top; and further includes a shelf mounting assembly for hingedly mounting the shelf member to the support assembly. None of the prior art includes the combination of the elements of the present invention.

There has thus been outlined, rather broadly, the more important features of the stud-supported storage assembly in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new stud-supported storage assembly which has many of the advantages of the pivotal shelves mentioned heretofore and many novel features that result in a new stud-supported storage assembly which is not anticipated, rendered obvious, suggested, or even implied by any of the prior art pivotal shelves, either alone or in any combination thereof.

Still another object of the present invention is to provide a new stud-supported storage assembly for providing addition storage space upon a wall member.

Still yet another object of the present invention is to provide a new stud-supported storage assembly that is easy and convenient to set up and use.

Even still another object of the present invention is to provide a new stud-supported storage assembly that conserves room space by having shelves which fold between the elongate stud members.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
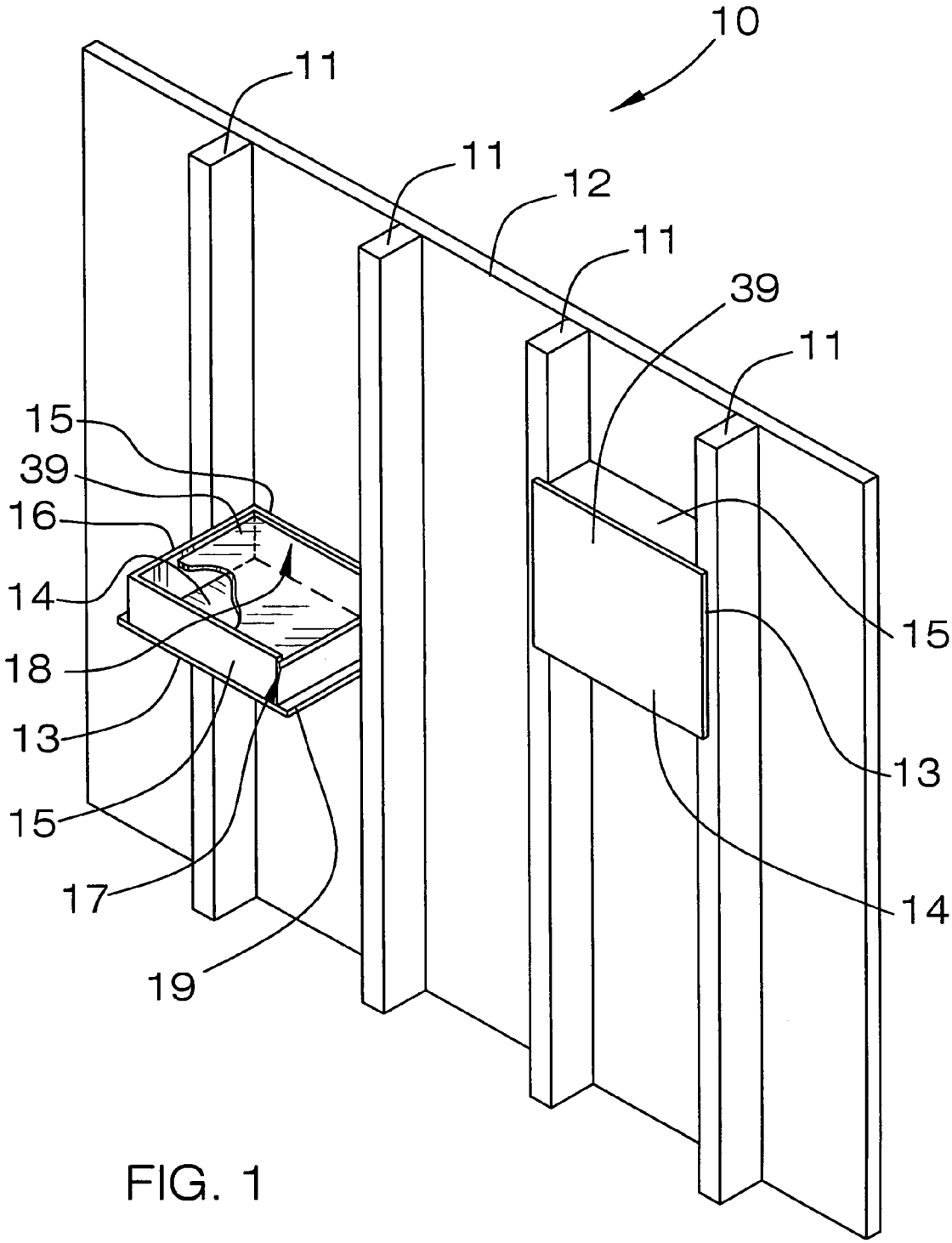
FIG. 1 is a perspective view of a new stud-supported storage assembly according to the present invention.
Figure 2:
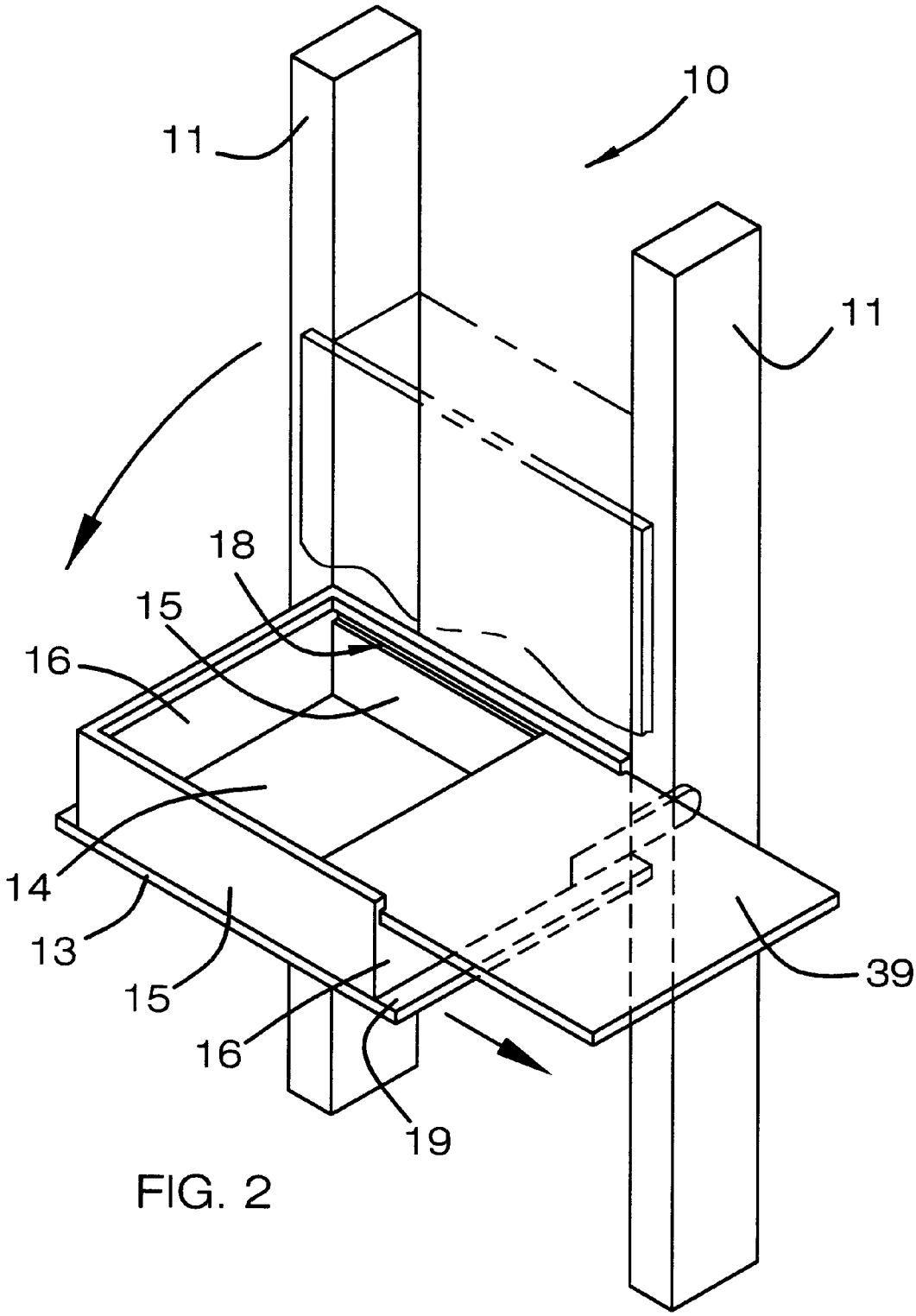
FIG. 2 is a detailed partial perspective view of the present invention.
Figure 3:
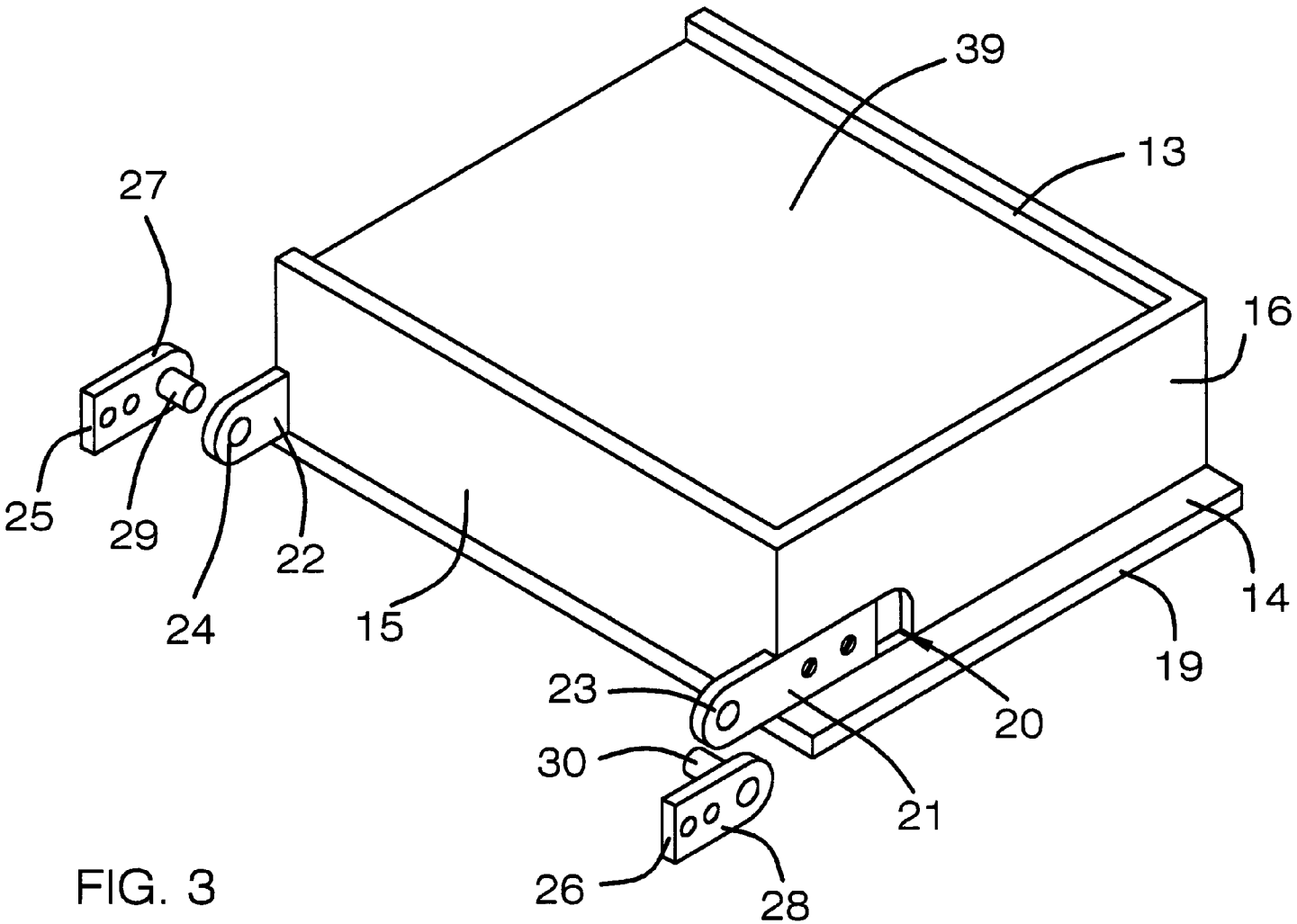
FIG. 3 is a detailed perspective view of one of the shelf members of the present invention.
Figure 4:
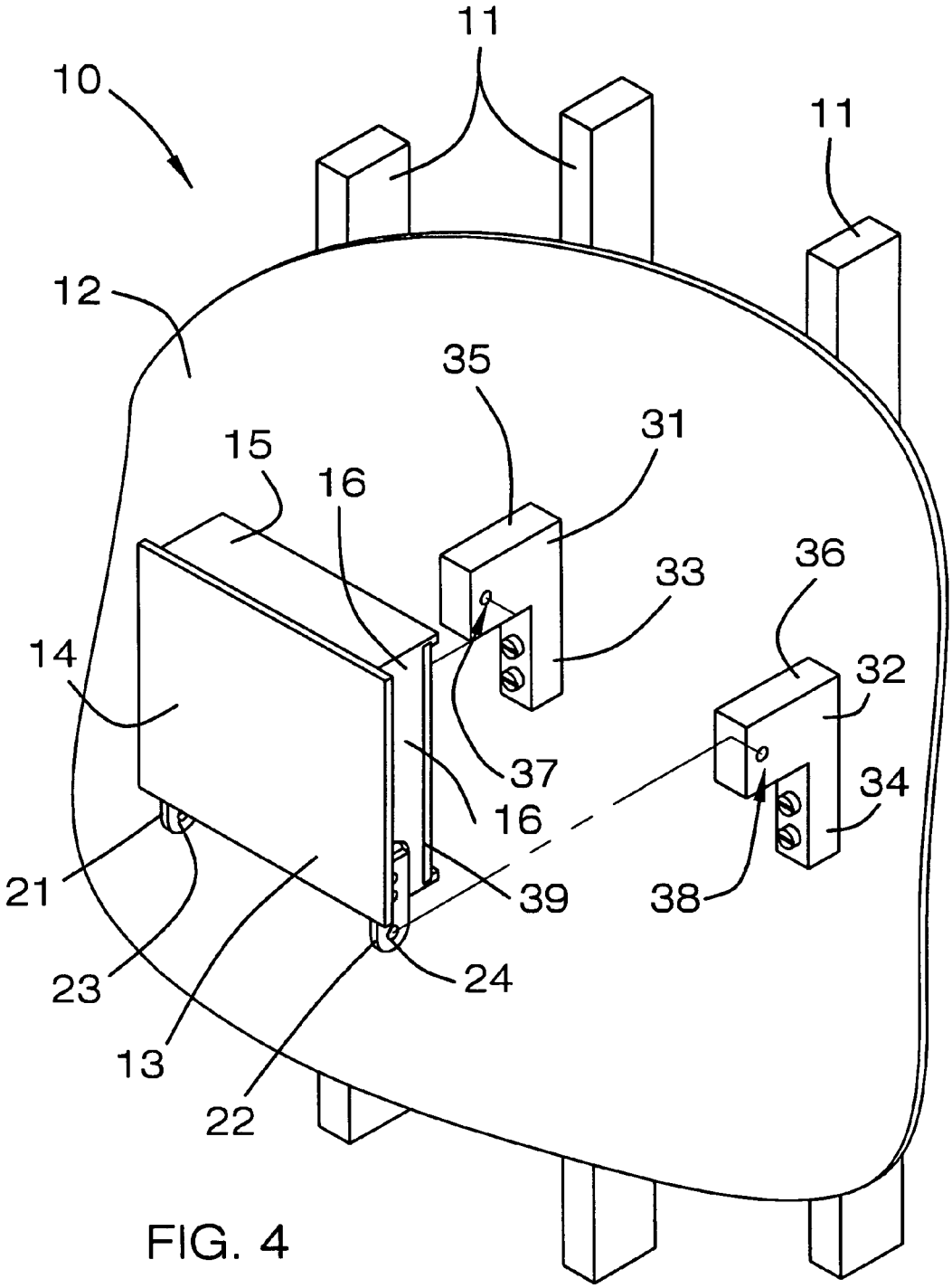
FIG. 4 is an exploded perspective view of a second embodiment of the present invention.

With reference now to the drawings, and in particular to FIGS. 1 through 4 thereof, a new stud-supported storage assembly embodying the principles and concepts of the present invention and generally designated by the reference numeral 10 will be described.

As best illustrated in FIGS. 1 through 4, the stud-supported storage assembly 10 generally comprises a support assembly including elongate stud members 11 being spaced apart, and also including a wall member 12 being conventionally attached to the elongate stud members 11.

A shelf assembly includes a shelf member 13 being hingedly attached to the support assembly and having bottom, side, and end walls 14–16 and an open top. The shelf member 13 also includes a cover 39 being removably disposed upon the open top of the shelf member 13. Each of the side walls 15 has a groove 17,18 being disposed in an interior side thereof and extending a length of the side wall 15. The cover 39 is received in the grooves 17,18 of the side walls 15. The side and end walls 15,16 are conventionally attached to the bottom wall 14 and are spaced from a perimeter edge of the bottom wall 14 with the bottom wall 14 having an overhang portion 19. The shelf member 13 also has elongate slots 20 being disposed in the side and end walls 15,16. Each of the elongate slots 20 extends along a portion of a respective end wall 16, and also extends through an edge of one of the side walls 15.

A shelf mounting assembly for hingedly mounting the shelf member 13 to the support assembly includes mounting brackets 21,22 being conventionally fastened in the elongate slots 20. Each of the mounting brackets 21,22 has an eyelet portion 23,24 extending outwardly beyond the one of the side walls 15 of the shelf member 13. The shelf mounting assembly also includes bracket members 25,26 being conventionally fastened to adjacently-disposed elongate stud members 11. Each of the bracket members 25,26 has an end portion 27,28 and also has a dowel 29,30 being perpendicularly and conventionally attached to the end portion 27,28 and being received in the eyelet portion 23,24 of a respective mounting bracket 21,22. The shelf member 13 is pivotally attached to the mounting brackets 21,22, and is pivotal in a stored position between the elongate stud members 11 with the cover 39 and the bottom wall 14 of the shelf member 13 being disposed generally parallel to the elongate stud members 11, and also is pivotal in an accessibly usable position with the cover 39 and the bottom wall 14 of the shelf member 13 being disposed generally perpendicular to the elongate stud members 14.

As a second embodiment, the shelf mounting assembly also includes shelf support members 31,32 being spacedly and conventionally attached to a side of the wall member 12. Each of the shelf support members 31,32 is an L-shaped block having a first portion 33,34 which is fastened to the wall member 12 and also having a second portion 35,36 which extends outwardly generally perpendicular to the wall member 12 and having a bore 37,38 being laterally-disposed therethrough. The mounting brackets 21,2 are pivotally and conventionally attached to the shelf support members 31,32. The shelf member 13 is pivotal in a stored position against the wall member 12 with the cover 39 and the bottom wall 14 of the shelf member 13 being disposed generally parallel to the wall member 12 and is also pivotal in an accessibly usable position with the cover 39 and the bottom wall 14 of the shelf member 13 being disposed generally perpendicular to the wall member 12.

In use, the user can pivot the shelf member 13 in the accessibly usable position so that the user can slide the cover 39 from the open top of the shelf member 13 to allow the user to gain access to the inside of the shelf member 13. Once finished, the user closes the cover 39 over the open top of the shelf member 13 and pivots the shelf member 13 into the stored position between the elongate stud members 11 to provide more room space without the shelf member 13 being exposed outwardly from the elongate stud members 11.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the stud-supported storage assembly. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A stud-supported storage assembly comprising:

a support assembly including elongate stud members being spaced apart, and also including a wall member being attached to said elongate stud members;

a shelf assembly including a shelf member being hingedly attached to said support assembly and having bottom, side, and end walls and an open top, said shelf member also including a cover being removably disposed upon said open top of said shelf member, each of said side walls having a groove being disposed in an interior side thereof and extending a length of said side wall, said cover being slidably received in said grooves of said side walls, said side and end walls being attached to said bottom wall and being spaced from a perimeter edge of said bottom wall, said bottom wall having an overhang portion, said shelf member also having elongate slots being disposed in said side and end walls; and a shelf mounting assembly for hingedly mounting said shelf member to said support assembly.

2. The stud-supported storage assembly as described in claim 1, wherein each of said elongate slots extends along a portion of a respective said end wall, and also extends through an edge of one of said side walls.

3. The stud-supported storage assembly as described in claim 2, wherein said shelf mounting assembly includes mounting brackets being fastened in said elongate slots, each of said mounting brackets having an eyelet portion extending outwardly beyond said side wall of said shelf member.

4. The stud-supported storage assembly as described in claim 3, wherein said shelf mounting assembly also includes bracket members being fastened to adjacent said elongate stud members; each of said bracket members having an end portion and also having a dowel being perpendicularly attached to said end portion and being received in said eyelet portion of a respective said mounting bracket; said shelf member being pivotally attached to said bracket members, and being pivotal in a stored position between said elongate stud members with said cover and said bottom wall of said shelf member being disposed generally parallel to said elongate stud members, and also being pivotal in an accessibly usable position with said cover and said bottom wall of said shelf member disposed generally perpendicular to said elongate stud members.

5. The stud-supported storage assembly as described in claim 3, wherein said shelf mounting assembly also includes shelf support members being spacedly attached to a side of said wall member; each of said shelf support members being an L-shaped block having a first portion which is fastened to said wall member and also having a second portion which extends outwardly generally perpendicular to said wall member and having a bore being laterally-disposed therethrough; said mounting brackets being pivotally attached to said shelf support members; said shelf member being pivotal in a stored position against said wall member with said cover and said bottom wall of said shelf member being disposed generally parallel to said wall member; and also being pivotal in an accessibly usable position with said cover and said bottom wall of said shelf member being disposed generally perpendicular to said wall member.

* * * * *